US009242706B2

(12) United States Patent
Lyons

(10) Patent No.: US 9,242,706 B2
(45) Date of Patent: Jan. 26, 2016

(54) DUAL KEEL KAYAK

(71) Applicant: Michael L. Lyons, Standish, ME (US)

(72) Inventor: Michael L. Lyons, Standish, ME (US)

( * ) Notice: Subject to any disclaimer, the term of this patent is extended or adjusted under 35 U.S.C. 154(b) by 0 days.

(21) Appl. No.: 14/279,455

(22) Filed: May 16, 2014

(65) Prior Publication Data

US 2014/0338584 A1 Nov. 20, 2014

Related U.S. Application Data

(60) Provisional application No. 61/855,467, filed on May 16, 2013.

(51) Int. Cl.
*B63B 35/71* (2006.01)

(52) U.S. Cl.
CPC ..... *B63B 35/71* (2013.01); *B63B 2035/715* (2013.01)

(58) Field of Classification Search
CPC ..... B63B 35/71; B63B 2035/715; B63B 2029/043
See application file for complete search history.

(56) References Cited

U.S. PATENT DOCUMENTS

| | | | | |
|---|---|---|---|---|
| 3,572,277 | A | 3/1971 | Schousboe | |
| 3,665,532 | A * | 5/1972 | Simpson | 114/347 |
| 4,229,850 | A | 10/1980 | Arcouette | |
| 5,257,590 | A * | 11/1993 | Foote et al. | 114/347 |
| 5,964,177 | A | 10/1999 | Niemier | |
| 5,975,006 | A | 11/1999 | Lewit | |
| D444,442 | S * | 7/2001 | Andrews | D12/318 |
| 6,394,020 | B1 * | 5/2002 | Belyeu | 114/357 |
| 6,871,608 | B2 * | 3/2005 | Rosen | 114/61.1 |
| 2002/0175542 | A1 | 11/2002 | McDonough et al. | |

* cited by examiner

*Primary Examiner* — Edwin Swinehart
(74) *Attorney, Agent, or Firm* — Pierce Atwood LLP; Kevin M. Farrell; David J. Wilson

(57) ABSTRACT

Described herein is a more ergonomic, more stable kayak design including parallel port and starboard keels protruding from a hull of the kayak, the keels are sized and positioned such that a paddler can rest a heel and/or foot in each keel at a lower elevation than the paddler's hips, the dual keels providing two-point contact with the ground.

14 Claims, 13 Drawing Sheets

DUAL KEEL KAYAK

TECHNICAL FIELD

The present disclosure relates generally to the field of paddle sports equipment. More particularly, this application relates to the technology of ergonomic kayak design.

BACKGROUND

Kayaking is a popular paddle sport, where paddlers operate a (traditionally) relatively long, narrow boat with a double paddle. There are many types of kayaks, including sea/touring kayaks, whitewater kayaks, recreational kayaks, and racing kayaks. Regardless of type, the paddler generally sits in the kayak such that the paddler's legs are out straight, or bent at the knee, but with the feet at the same level as the paddler's lower back and hips. Unfortunately, such a seating arrangement can create significant discomfort (e.g., in the lower back and hips) in a relatively brief matter of time on the water. This can be especially onerous for older paddlers and/or persons with hip, joint, or back issues.

Additionally, traditional kayaks, especially kayaks such as touring kayaks which have narrower, more v-shaped hulls (e.g., as compared to a wider, flatter whitewater kayak) are inherently unstable when "beached" (i.e., at least partially resting on land or another, non-fluid surface or object) for paddler ingress and egress. This instability can cause even experienced paddlers to occasionally tip the kayak over during ingress/egress and, for beginner paddlers, older paddlers, and/or less athletically inclined paddlers, the instability can be so difficult as to dissuade them from even participating in the sport.

SUMMARY

A need therefore exists for a more ergonomic, more stable kayak design which minimizes any negative impact on hydrodynamic performance.

In one aspect, at least one embodiment described herein provides a kayak. The kayak includes a hull extending longitudinally between a bow and a stern, wherein the hull includes a port portion and a starboard portion. The kayak also includes a first keel protruding from the port portion of the hull, the first keel positioned between the bow and the stern and sized to at least partially receive a heel and/or a foot of a paddler. The keel also includes a second keel protruding from the starboard portion of the hull and parallel or essentially parallel to the first keel, the second keel sized to at least partially receive a heel and/or a foot of the paddler.

Any of the aspects and/or embodiments described herein can include one or more of the following embodiments. In some embodiments, the kayak includes a deck extending from the hull, the deck and the hull together defining an interior volume of the kayak. In some embodiments, the kayak includes at least one cockpit defined in the deck. In some embodiments, the kayak includes at least one footrest positioned in each of the first keel and the second keel. In some embodiments, the at least one footrest is repositionable within each of the first keel and the second keel. In some embodiments, the kayak includes a seat positioned aft of at least a portion of the first and second keels. In some embodiments, the seat is repositionable relative to the first and second keels.

In some embodiments, the kayak includes two or more seats, wherein each of the first and second keels is positioned to simultaneously receive a heel and/or foot of a paddler seated in each seat. In some embodiments, the kayak includes a first seat positioned aft of at least a portion of the first and second keels. In some embodiments, the kayak includes a third keel protruding from the port portion of the hull, the third keel positioned aft of the first keel and sized to at least partially receive a heel and/or a foot of the paddler. In some embodiments, the kayak includes a fourth keel protruding from the starboard portion of the hull and parallel or essentially parallel to the third keel, the fourth keel sized to at least partially receive a heel and/or a foot of the paddler. In some embodiments, the kayak includes a second seat positioned aft of at least a portion of the third and fourth keels.

In some embodiments, a length of the first keel and a length the second keel are each less than a length of the hull and a width of the first keel combined with a width of the second keel is less than a width of the hull. In some embodiments, the hull includes a hull beam profile, the first keel includes a first keel beam profile, and the second keel includes a second keel beam profile. In some embodiments, the hull beam profile is different than the first keel beam profile and the second keel beam profile. In some embodiments, the first keel beam profile and the second keel beam profile are essentially the same. In some embodiments, the first keel and the second keel extend away from the hull into a body of water when the kayak is deployed in the body of water.

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

DETAILED DESCRIPTION

In the following detailed description of the illustrated embodiments, reference is made to accompanying drawings, which form a part thereof, and within which are shown by way of illustration, specific embodiments, by which the subject matter may be practiced. It is to be understood that other embodiments may be utilized and structural changes may be made without departing from the scope of the disclosure.

The particulars shown herein are by way of example and for purposes of illustrative discussion of the embodiments only and are presented in the case of providing what is believed to be the most useful and readily understood description of the principles and conceptual aspects of the disclosure. In this regard, no attempt is made to show structural details of the subject matter in more detail than is necessary for the fundamental understanding of the disclosure, the description taken with the drawings making apparent to those skilled in the art how the several forms of the present disclosure may be embodied in practice. Further, like reference numbers and designations in the various drawings indicate like elements.

Described herein is a more ergonomic, more stable kayak design which includes at least two parallel keels (one on a port side of the kayak and one on a starboard side of the kayak) protruding from a hull of the kayak. Each keel has a hollow interior and is sized such that a paddler can rest a heel and/or foot in the keel. The paddler's feet, by resting below the hull, one in each keel, are positioned at a lower elevation than the paddler's hips, alleviating the ergonomic discomfort associated with other kayak designs. Additionally, the presence of two, parallel keels provides added stability during ingress/egress because the dual keels provide two-point contact with the ground, rather than single point contact.

Figure 1A:
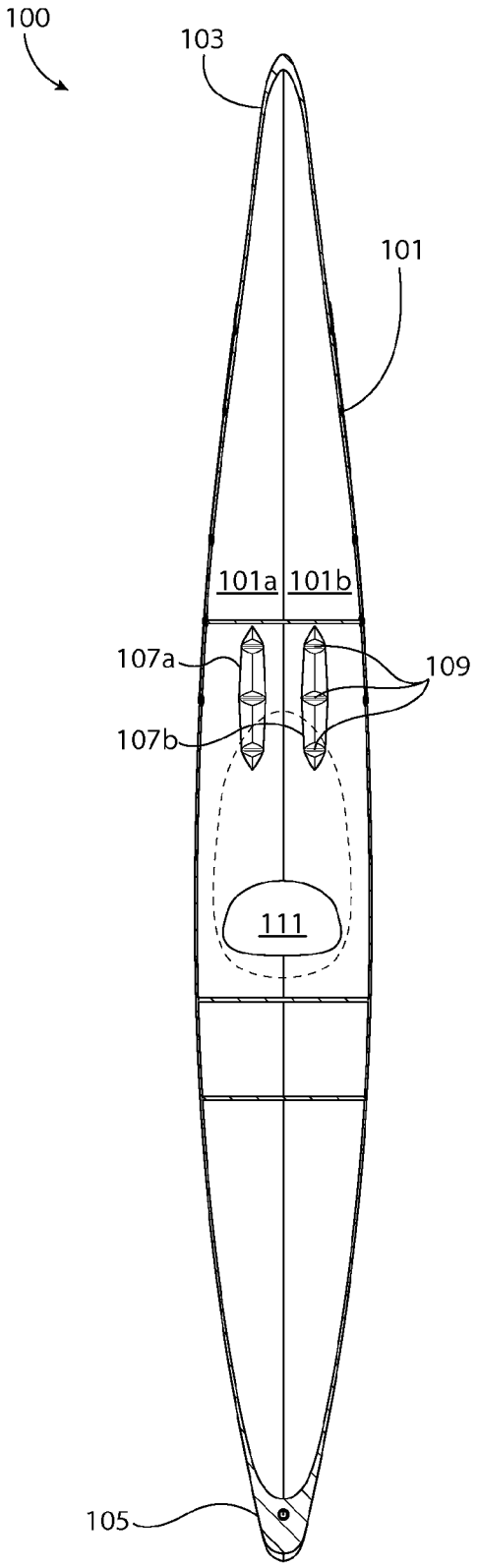
FIG. 1A is a cross-sectional top view of a kayak in accordance with various embodiments.
Figure 1B:
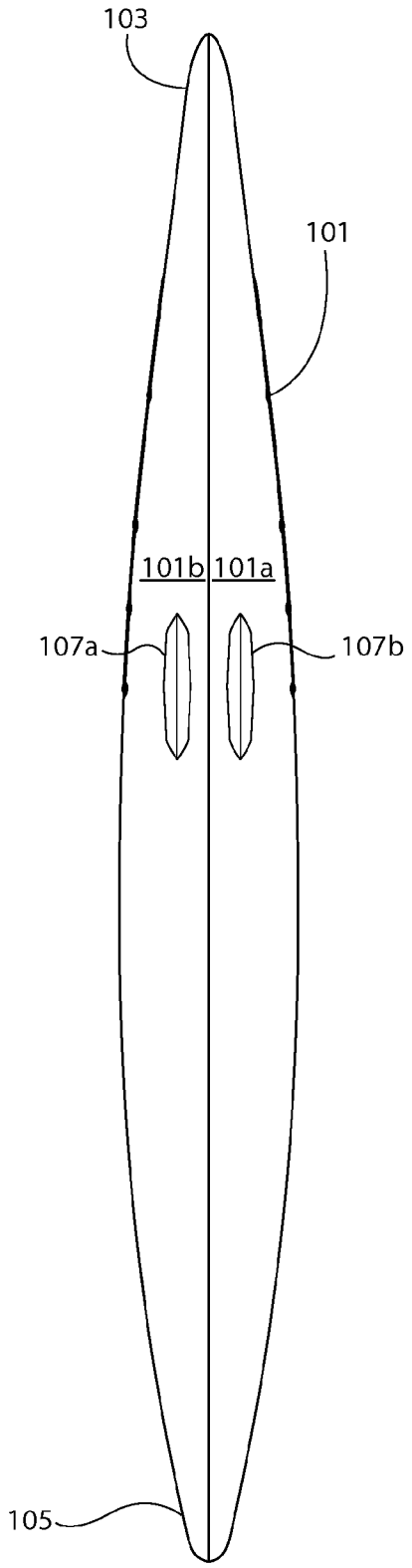
FIG. 1B is a bottom view of a kayak in accordance with various embodiments.

Referring to FIGS. 1A-1G, in accordance with various embodiments, a dual keel kayak 100 includes a hull 101 extending between a bow 103 and a stern 105. The hull 101 includes a port portion 101*a* and a starboard portion 101*b*, divided by a longitudinal axis of the hull 101. The kayak 100 includes a first keel 107*a* protruding from the port portion 101*a* and a second keel 107*b* protruding from the starboard portion 101*b* and substantially parallel to the first keel 107*a*. As best shown in FIG. 1A, each of the first keel 107*a* and the second keel 107*b*, in accordance with various embodiments, can include one or more footrests 109 designed for a paddler to rest a foot and/or a heel thereon. The kayak 100 can, in accordance with various embodiments, also include a seat 111 for the paddler to sit on. The kayak 100, in accordance with various embodiments, can also include a deck 113 (omitted in FIG. 1A for clarity) extending from the hull 101 to define an interior volume of the kayak 100. The deck 113 can, in accordance with various embodiments, include a cockpit 115 which can, in accordance with various embodiments, be vertically aligned with the seat 111.

Figure 1C:
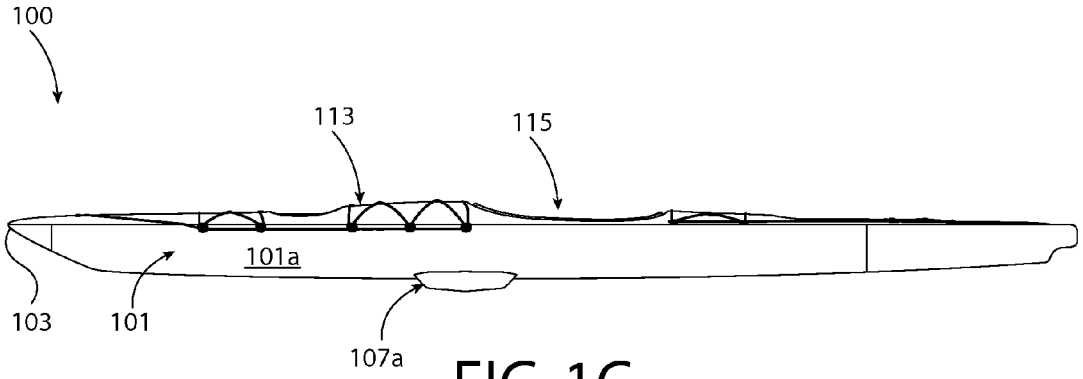
FIG. 1C is a side view of a kayak in accordance with various embodiments.

The hull 101 extends between the bow 103 and the stern 105 and includes a port portion 101*a* and a starboard portion 101*b*. The hull 101, in accordance with various embodiments, can be constructed from any suitable material, including for example but not limited to, plastics, polymers, polyethylene, fiberglass, carbon fiber, composites, wood, plywood, canvas, nylon, rubber, metals, polyester, fabrics, neoprene, Nitrylon, Kevlar, polyvinyl chloride (PVC), and/or polyurethane). As best shown in FIG. 1C, the hull 101, along its length, defines a rocker profile (i.e., the lengthwise curvature of the hull 101 along the longitudinal axis). The hull 101 of the example kayak 100 illustrated by FIGS. 1A-1G includes very little rocker (i.e., is minimally curved) which allows for better cutting through waves and better tracking. It will, however, be apparent in view of this disclosure that any suitable rocker curvature can be used.

Figure 1D:
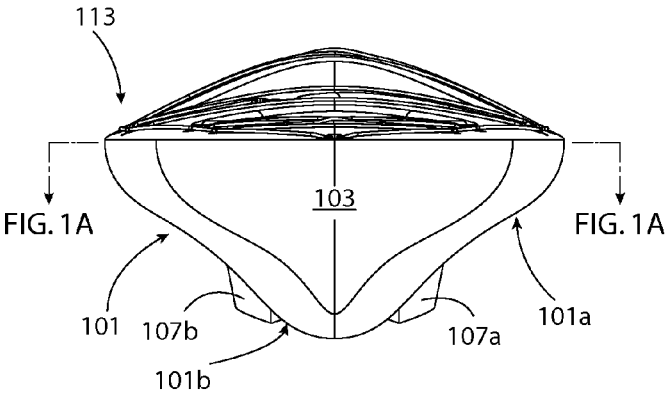
FIG. 1D is a front view of a kayak in accordance with various embodiments.
Figure 1E:
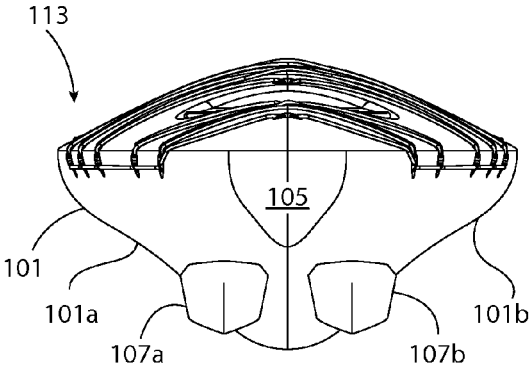
FIG. 1E is a rear view of a kayak in accordance with various embodiments.

As best shown in FIGS. 1D and 1E, the port portion 101*a* and starboard portion 101*b*, in combination, define a cross-sectional shape (beam profile) of the hull 101. The hull 101 of the example kayak 100 illustrated by FIGS. 1A-1G includes a v-shaped beam profile, most commonly associated with a touring or sea kayak 100. It will, however, be apparent in view of this disclosure that any suitable beam profile can be used (e.g., a flat bottom profile, a round bottom profile, an s-bottom hull, a hard chine, and/or a soft chine). It will further be apparent in view of this disclosure that the maximum width of the hull 101 can be located anywhere between the bow 103 and the stern 105 and that, therefore, any hull surface profile (e.g., symmetrical, fish form, or Swede form) known to one of skill in the art can be used.

The first keel 107*a* and second keel 107*b* protrude from the port portion 101*a* and the starboard portion 101*b* and are advantageously positioned substantially parallel along the longitudinal axis of the hull 101. The first and second keels 107*a*, 107*b* can, in accordance with various embodiments, be constructed from any suitable material, including for example but not limited to, plastics, polymers, polyethylene, fiberglass, carbon fiber, composites, wood, plywood, canvas, nylon, rubber, metals, polyester, fabrics, neoprene, Nitrylon, Kevlar, polyvinyl chloride (PVC), and/or polyurethane). In accordance with various embodiments, the first and second keels 107*a*, 107*b* can be constructed of the same material(s) as the hull 101 or can be constructed from different material (s) than the hull 101. In accordance with various embodiments, the first and second keels 107*a*, 107*b* can be constructed as a single piece with the hull 101 or can be constructed separately and subsequently be attached to the hull 101 (e.g., via an adhesive or a mechanical fastener).

The first and second keels 107*a*, 107*b* can, in accordance with various embodiments, be dimensioned with any suitable length, width, and/or depth according to a desired design. Additionally, the first keel 107*a* can, in accordance with various embodiments, be positioned at any distance port of the longitudinal axis (i.e., anywhere from adjacent to the longitudinal axis on the port portion 101*a* to adjacent to the portmost point of the kayak 100 on the port portion 101*a*). Similarly, the second keel 107*b* can, in accordance with various embodiments, be positioned at any distance starboard of the longitudinal axis (i.e., anywhere from adjacent to the longitudinal axis on the starboard portion 101*b* to adjacent to the starboardmost point of the kayak 100 on the starboard portion 101*b*). In accordance with various embodiments, the first and second keels 107*a*, 107*b* can be positioned symmetrically relative to the longitudinal axis (i.e., equidistant from the longitudinal axis) or can be positioned asymmetrically relative to the longitudinal axis (i.e., not equidistant from the longitudinal axis).

Figure 1F:
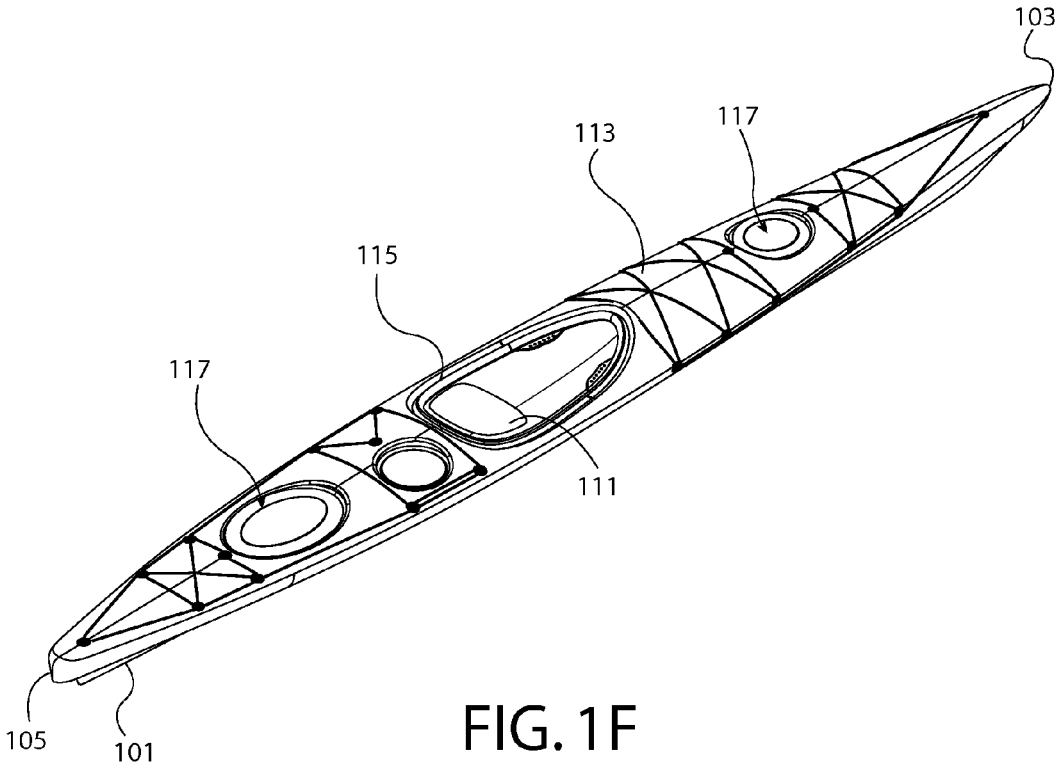
FIG. 1F is an elevated perspective view of a kayak in accordance with various embodiments.
Figure 1G:
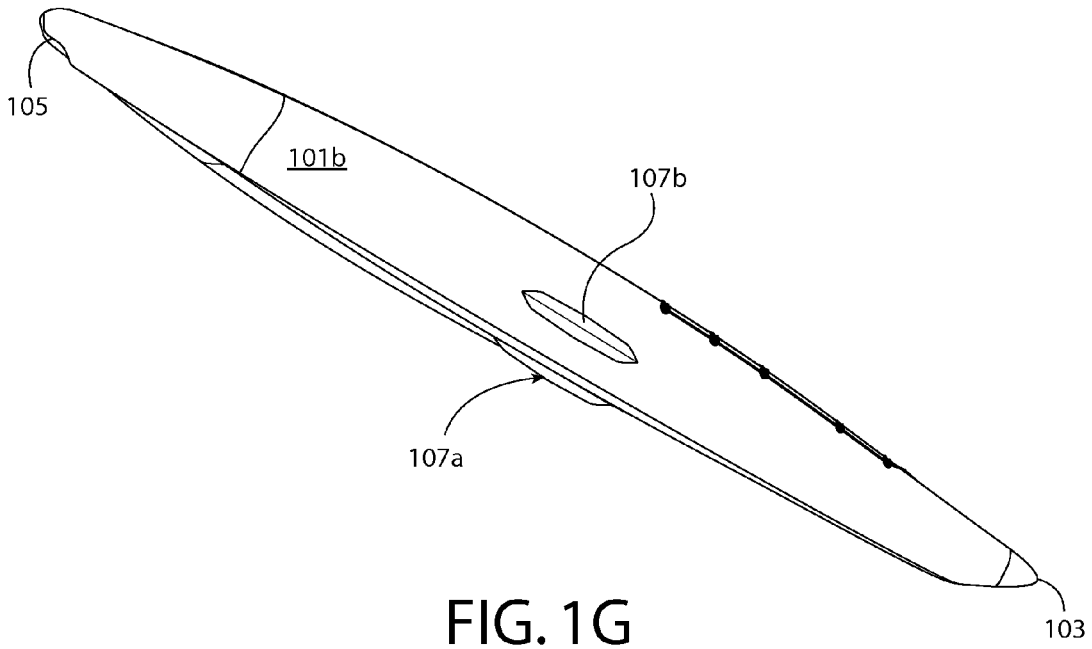
FIG. 1G is a declined perspective view of a kayak in accordance with various embodiments.
Figure 2A:
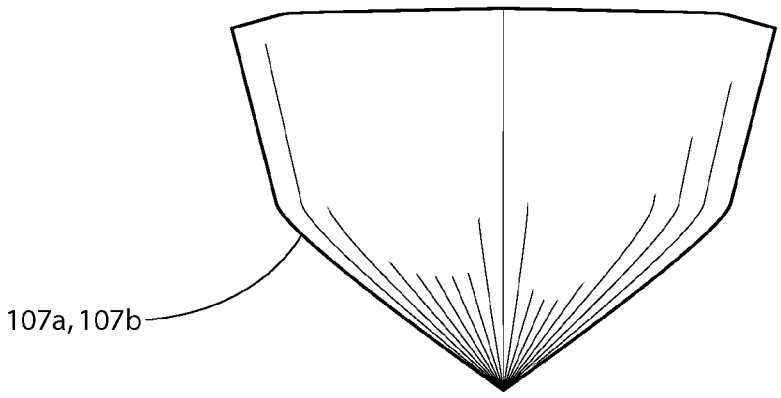
FIG. 2A is a cross-sectional view of a keel in accordance with various embodiments.
Figure 2B:
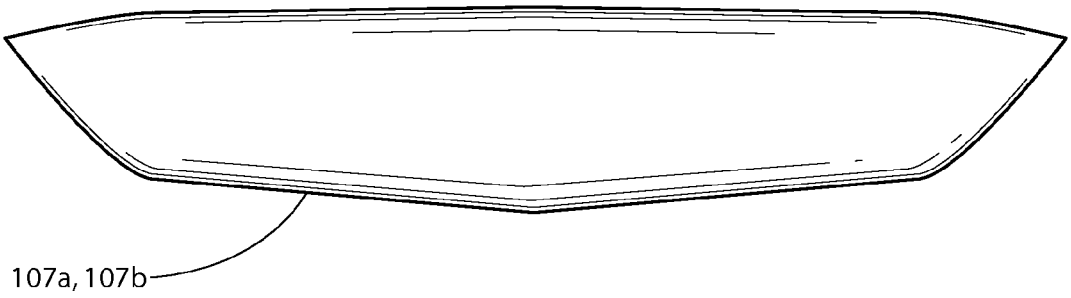
FIG. 2B is a side view of a keel in accordance with various embodiments.

As best shown in FIGS. 1C and 2B, the keels 107*a*, 107*b* each define a rocker profile (i.e., the lengthwise curvature of the each keel 107*a*, 107*b*). As best shown in FIG. 1C, the exemplary keels 107*a*, 107*b* illustrated in FIGS. 1A-2B include slightly greater rocker curvature than the hull 101. It will, however, be apparent in view of this disclosure that any suitable keel rocker curvature can be used and that, in accordance with various embodiments, the rocker curvature of the keels 107*a*, 107*b* can be the same as, similar to, and/or different than the rocker curvature of the hull 101.

As best shown in FIGS. 1D and 1E, each of the keels 107*a*, 107*b*, defines a cross-sectional shape (beam profile) of the keel 107*a*, 107*b*. The beam profile of the exemplary keels 107*a*, 107*b* of the example kayak 100 illustrated by FIGS. 1A-2B includes a similar v-shaped beam profile to the beam profile of the hull 101. It will, however, be apparent in view of this disclosure that any suitable beam profile can be used and that, in accordance with various embodiments, the beam profile of the keels 107*a*, 107*b* can be the same as, similar to, and/or different than the beam profile of the hull 101. It will be further apparent in view of this disclosure that, while the first keel 107*a* and the second keel 107*b* are illustrated as having the same rocker curvature and beam profile in FIGS. 1A-2B, the rocker curvature and/or the beam profile of the first keel 107*a* can be different from or the same as the rocker curvature and/or the beam profile of the second keel 107*b*.

The first and second keels 107*a*, 107*b*, in accordance with various embodiments, are positioned in parallel and forward of the seat 111. Such positioning is advantageous because it provides a stable two-point contact with the ground during ingress/egress and because it allows the paddler to advantageously position his or her feet one in each keel, thereby increasing the height differential between the paddler's feet and the paddler's hips and lower back. As shown in FIG. 1A, multiple footrests 109 can be included at various positions within each keel 107*a*, 107*b* in order to accommodate paddlers of differing height. It will be apparent in view of this disclosure that a single footrest 109 or any other number of footrests 109 can also be used. It will also be apparent in view of this disclosure that, in accordance with various embodiments, an adjustable footrest can also be used to provide improved customizability. However, it should be noted that inclusion of an adjustable footrest may generally involve a partial tradeoff between the customizability of the adjustable footrest and the ergonomic benefits of a lowered foot positioning. This tradeoff is caused because the added height of the adjustment mechanism of the adjustable footrest will cause the paddler's feet to be more elevated relative to a fixed footrest configuration.

The seat 111 can be positioned anywhere between the bow 103 and the stern 105 along the longitudinal axis. In accordance with various embodiments, the seat is positioned aft of the first and second keels 107*a*, 107*b*. The seat 111 can, in accordance with various embodiments, be molded into the hull 101, or can be a separately constructed element and be attached to the interior of the hull 101. In accordance with various embodiments, the seat 111 can be in a fixed longitudinal position or can be adjustable forward or aft along the longitudinal axis.

The deck 113, as best shown in FIG. 1F, extends from the hull 101 to enclose an interior volume of the kayak 100. The deck 113 can, in accordance with various embodiments, extend upward in a convex arc or other shape over the hull 101, extend directly across the hull 101 in a flat planar shape, and/or extend downward into the hull 101 in a concave arc or other shape. In accordance with various embodiments, the deck can be constructed from any suitable material, including for example but not limited to, plastics, polymers, polyethylene, fiberglass, carbon fiber, composites, wood, plywood, canvas, nylon, rubber, metals, polyester, fabrics, neoprene, Nitrylon, Kevlar, polyvinyl chloride (PVC), and/or polyurethane). The deck 113, in accordance with various embodiments, can be constructed of the same material(s) as the hull 101 or can be constructed from different material(s) than the hull 101. In accordance with various embodiments, the deck 113 can be constructed as a single piece with the hull 101 or can be constructed separately and subsequently be attached to the hull 101 (e.g., via an adhesive or a mechanical fastener).

The deck 113, in accordance with various embodiments, can define one or more cockpits 115 to provide ingress and egress for the paddler. In accordance with various embodiments, the cockpit can be vertically aligned with the seat 111 so that a lower body of the paddler is enclosed by the interior volume of the kayak 100 and the upper body of the paddler extends through the cockpit 115, enabling the paddler to provide propulsion by paddling. In accordance with various embodiments, the cockpit can be configured for removable attachment of a spray deck. In addition to a cockpit 115, the deck can also be configured to define one or more cargo holds 117, which can be covered or uncovered.

Figure 3A:
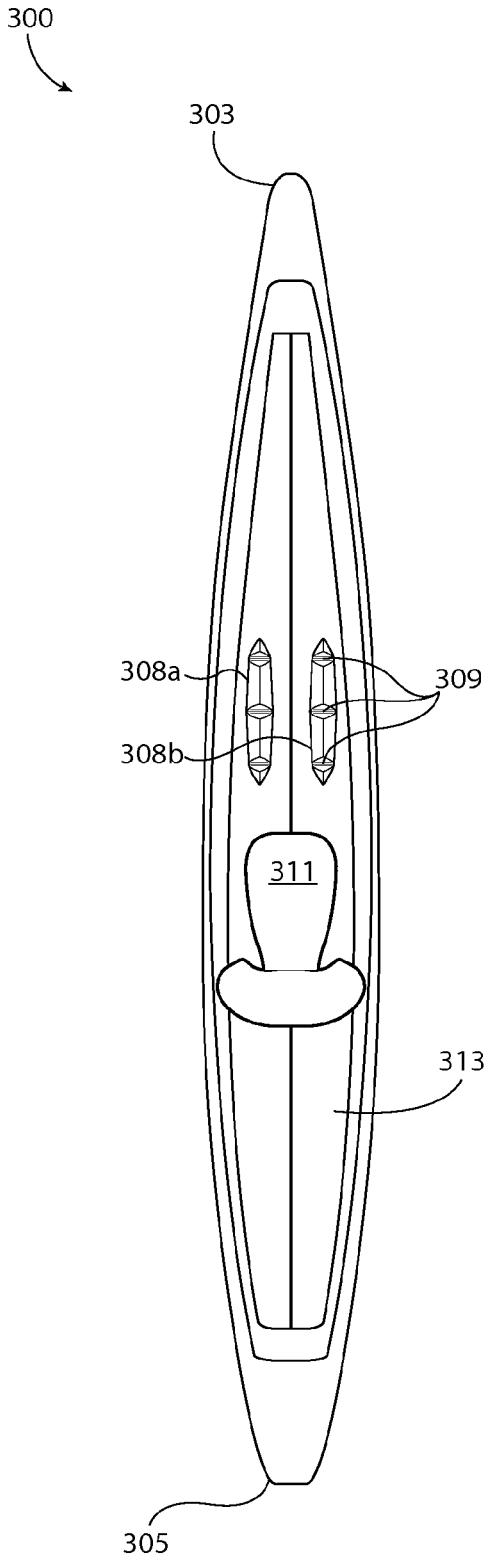
FIG. 3A is a top view of an open-top kayak in accordance with various embodiments.
Figure 3B:
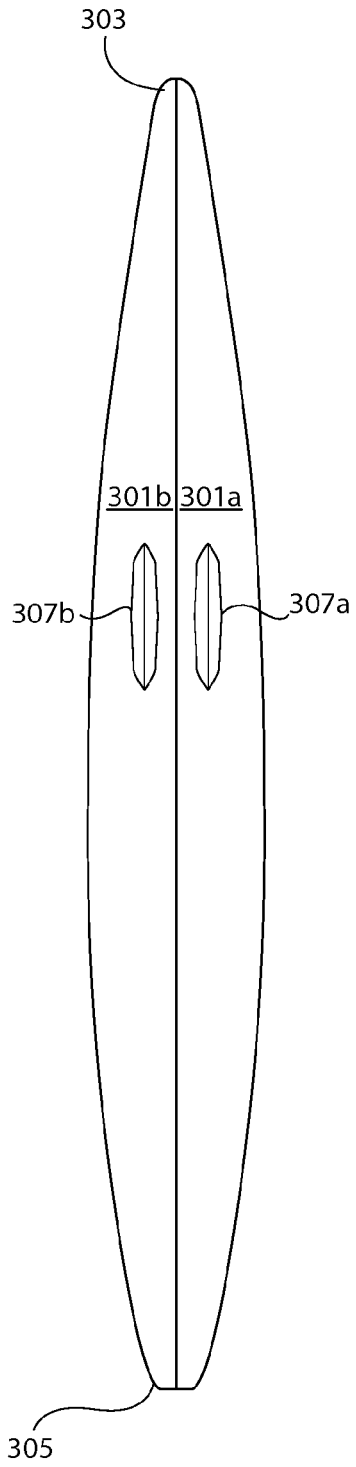
FIG. 3B is a bottom view of an open-top kayak in accordance with various embodiments.
Figure 3C:
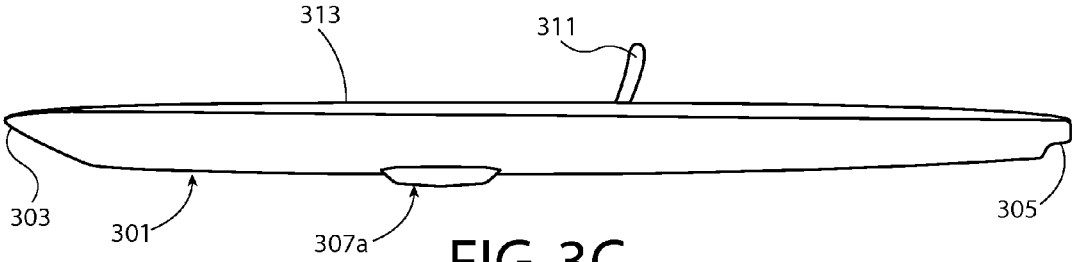
FIG. 3C is a side view of an open-top kayak in accordance with various embodiments.
Figure 3D:
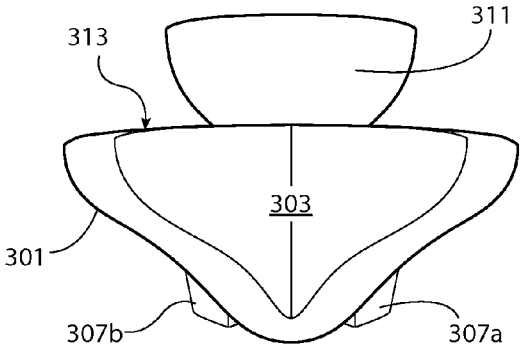
FIG. 3D is a front view of an open-top kayak in accordance with various embodiments.
Figure 3E:
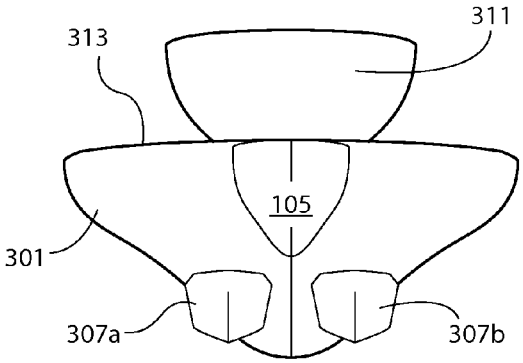
FIG. 3E is a rear view of an open-top kayak in accordance with various embodiments.
Figure 3F:
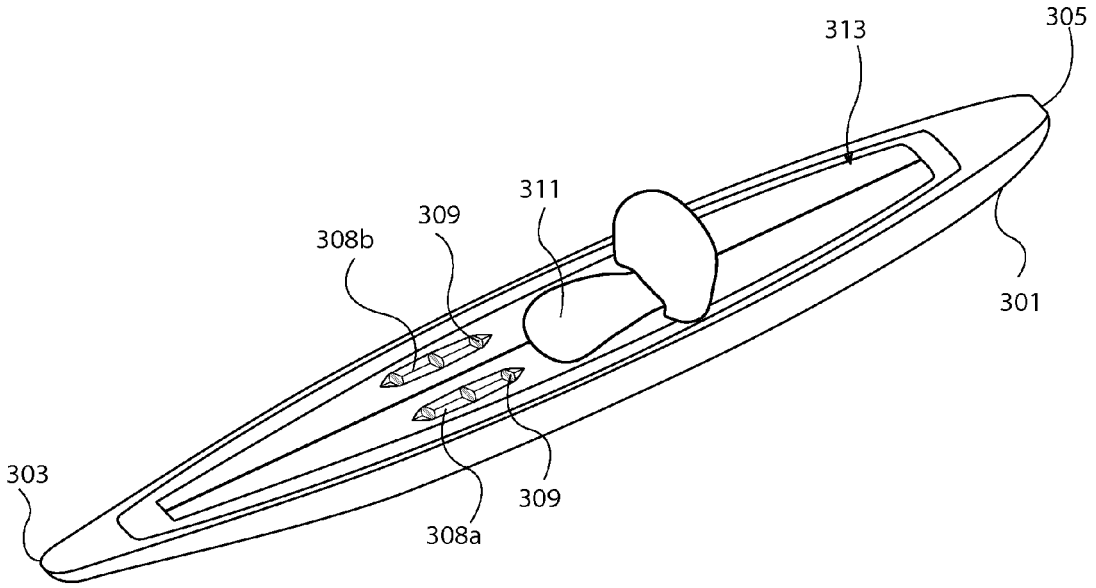
FIG. 3F is an elevated perspective view of an open-top kayak in accordance with various embodiments.
Figure 3G:
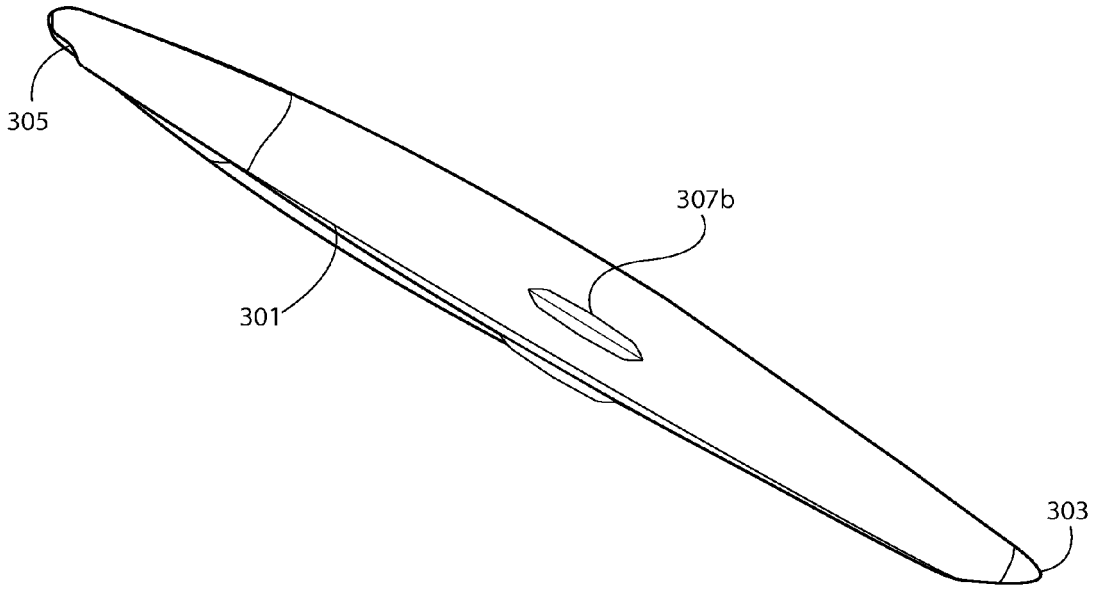
FIG. 3G is a declined perspective view of an open-top kayak in accordance with various embodiments.
Figure 4A:
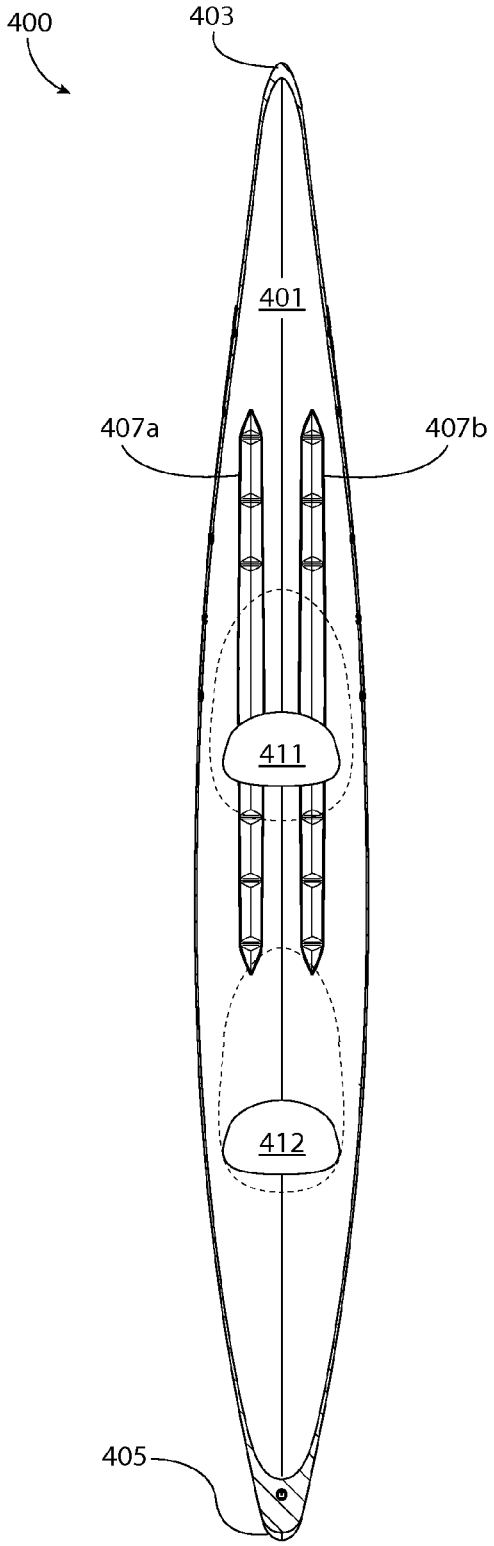
FIG. 4A is a cross-sectional top view of a two-seat kayak in accordance with various embodiments.
Figure 4B:
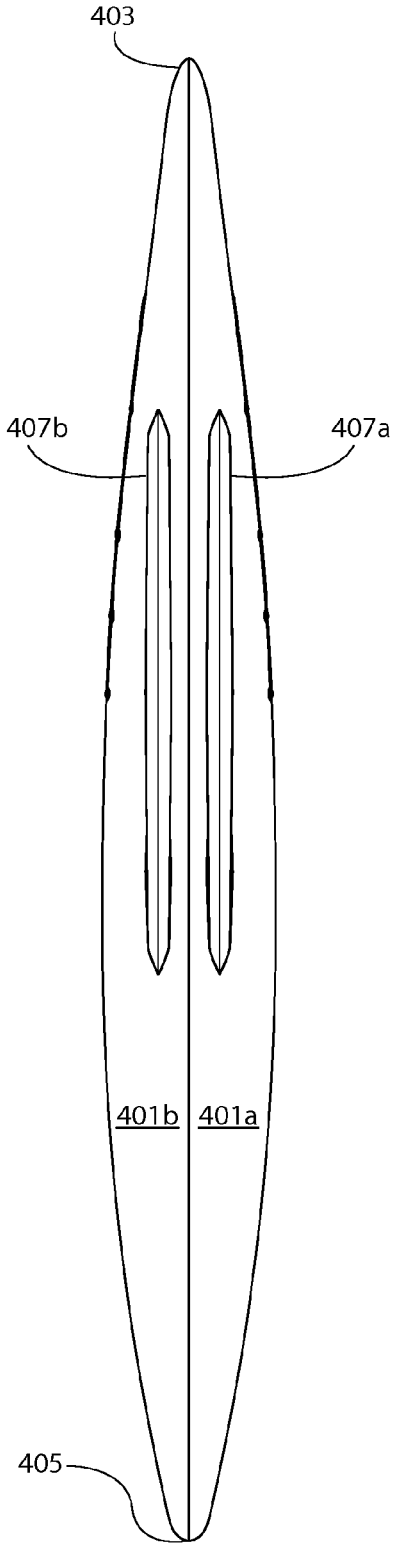
FIG. 4B is a bottom view of a two-seat kayak in accordance with various embodiments.
Figure 4C:
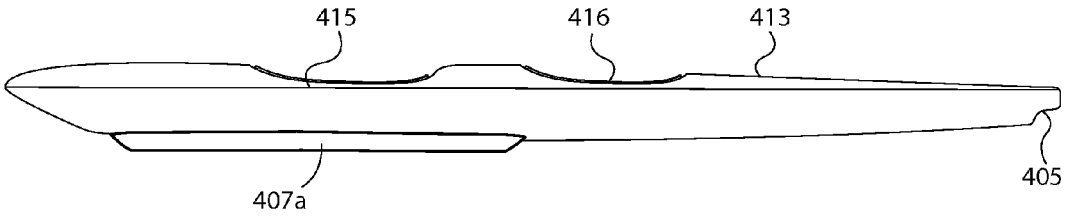
FIG. 4C is a side view of a two-seat kayak in accordance with various embodiments.
Figure 4D:
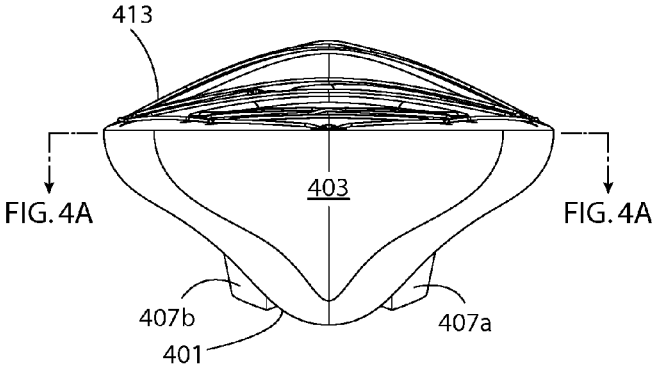
FIG. 4D is a front view of a two-seat kayak in accordance with various embodiments.
Figure 4E:
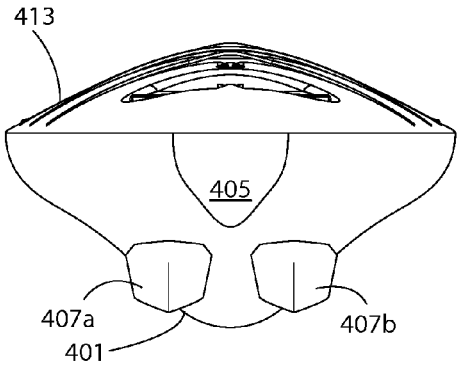
FIG. 4E is a rear view of a two-seat kayak in accordance with various embodiments.
Figure 4F:
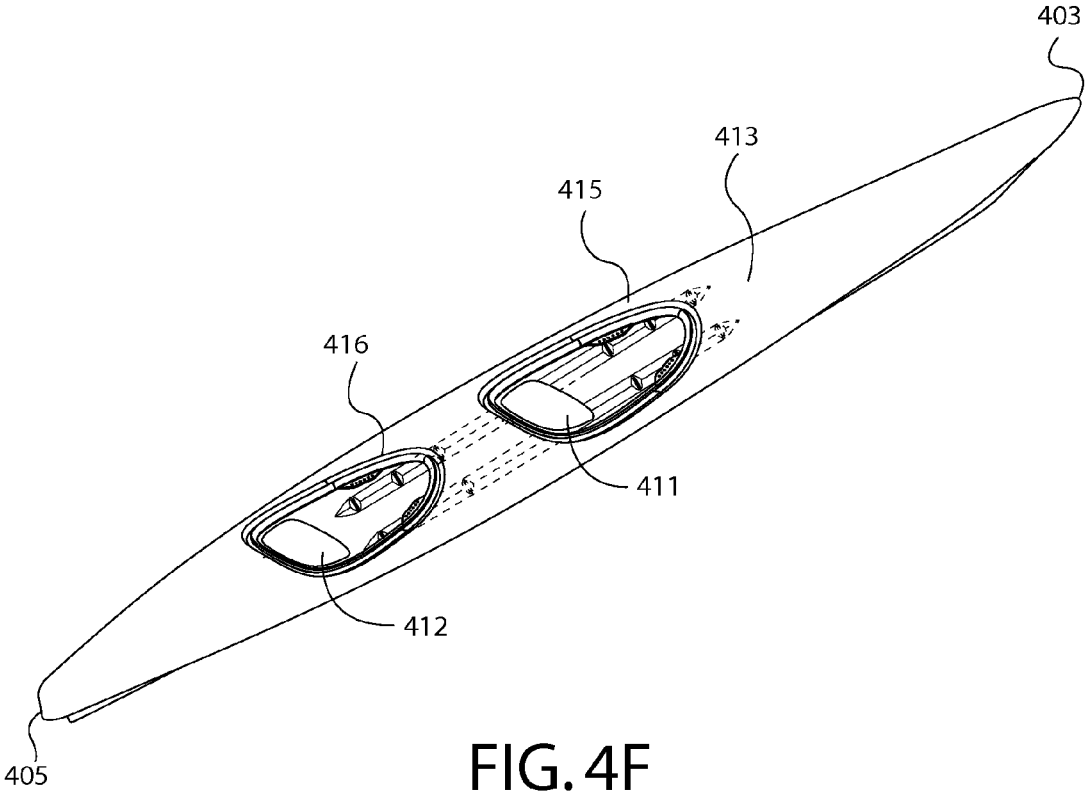
FIG. 4F is an elevated perspective view of a two-seat kayak in accordance with various embodiments.
Figure 4G:
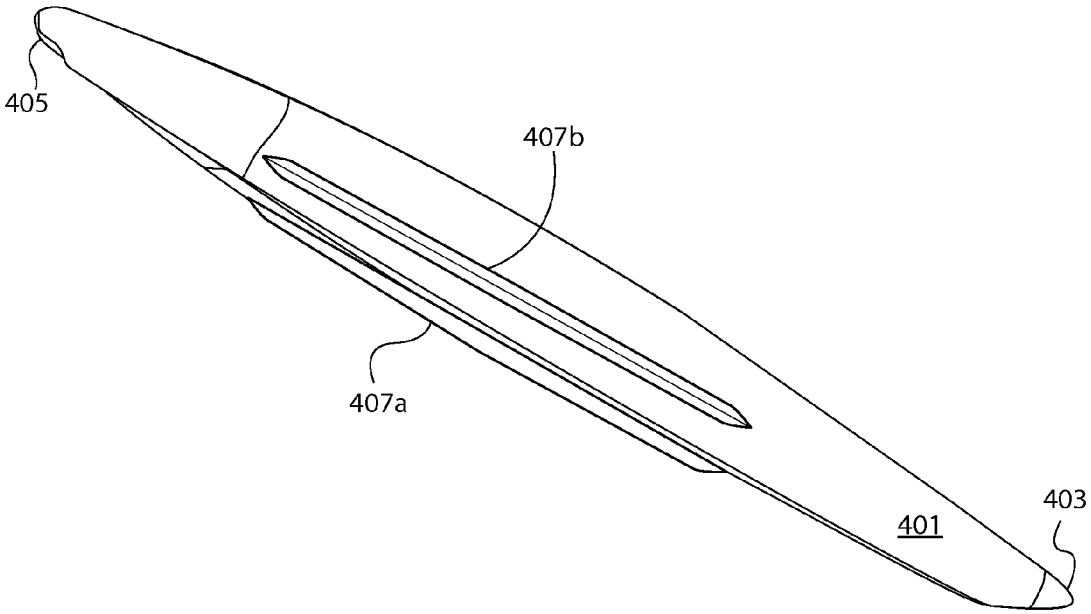
FIG. 4G is a declined perspective view of a two-seat kayak in accordance with various embodiments.
Figure 5A:
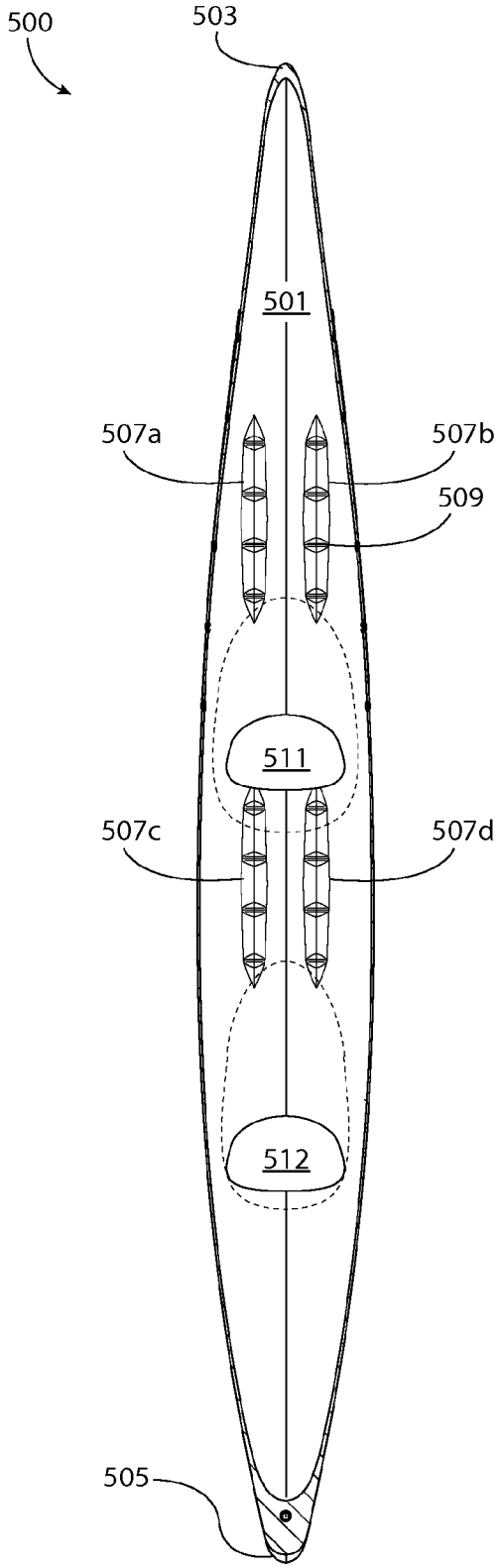
FIG. 5A is a cross-sectional top view of an alternate two-seat kayak in accordance with various embodiments.
Figure 5B:
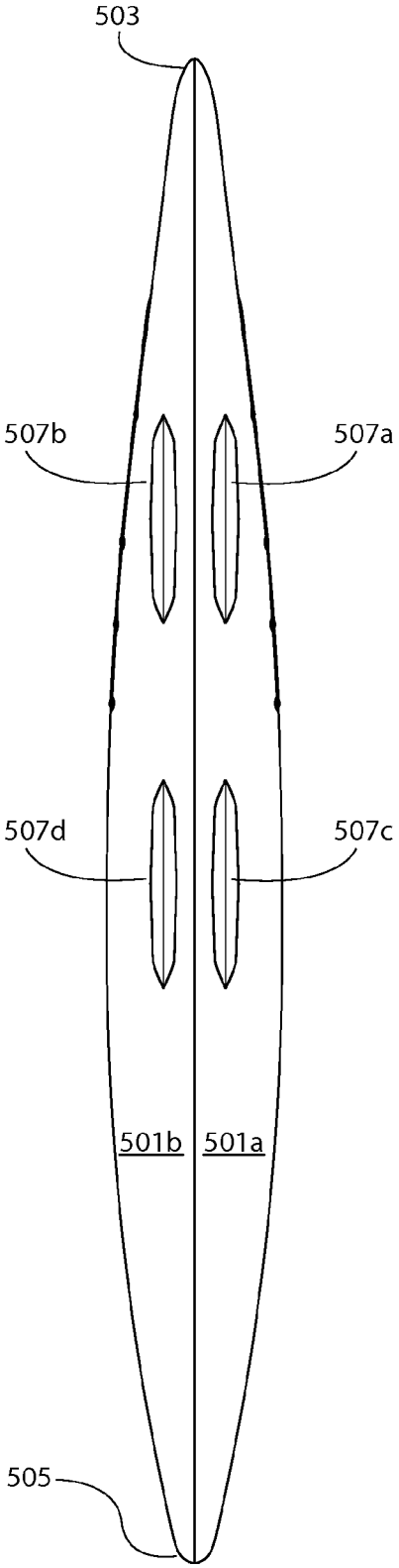
FIG. 5B is a bottom view of an alternate two-seat kayak in accordance with various embodiments.
Figure 5C:
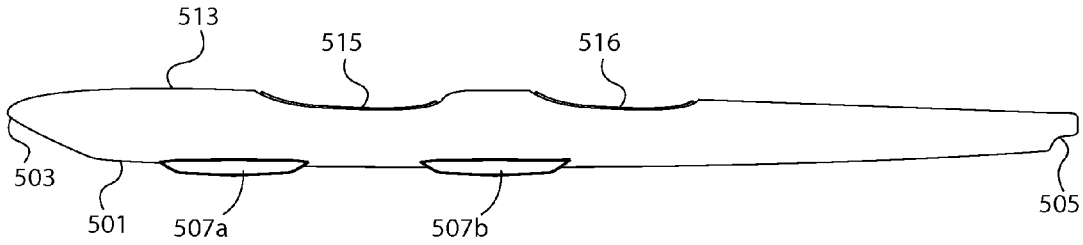
FIG. 5C is a side view of an alternate two-seat kayak in accordance with various embodiments.
Figure 5D:
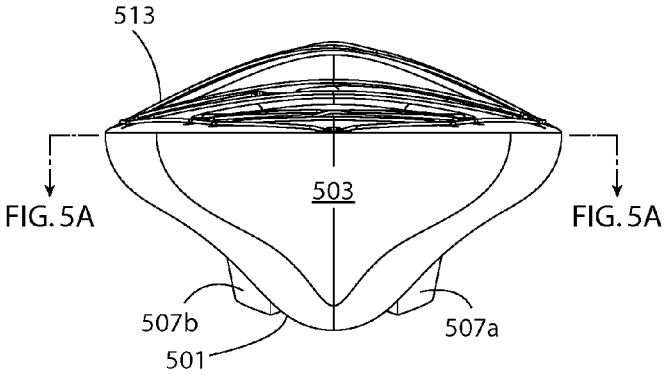
FIG. 5D is a front view of an alternate two-seat kayak in accordance with various embodiments.
Figure 5E:
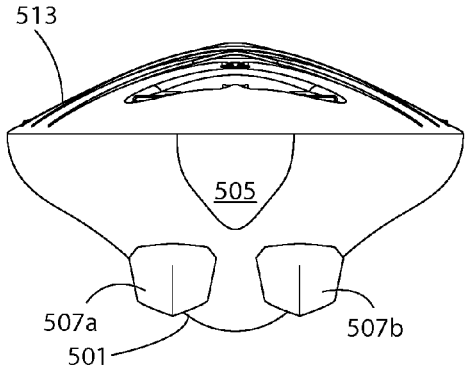
FIG. 5E is a rear view of an alternate two-seat kayak in accordance with various embodiments.
Figure 5F:
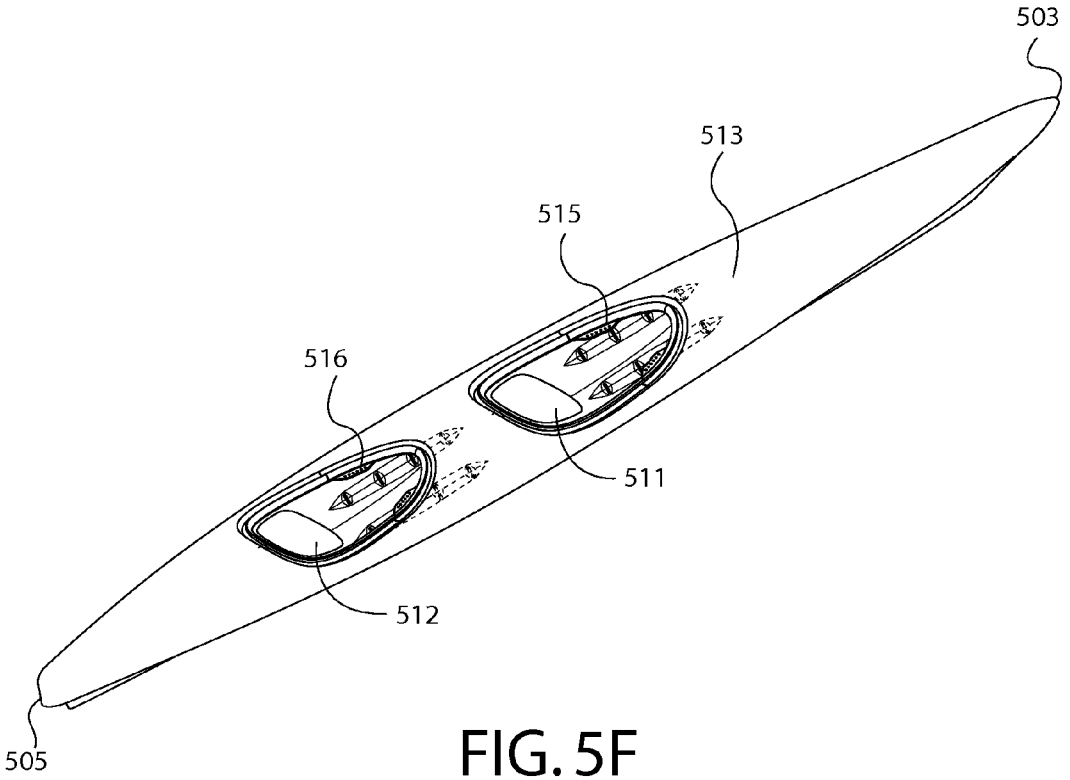
FIG. 5F is an elevated perspective view of an alternate two-seat kayak in accordance with various embodiments.
Figure 5G:
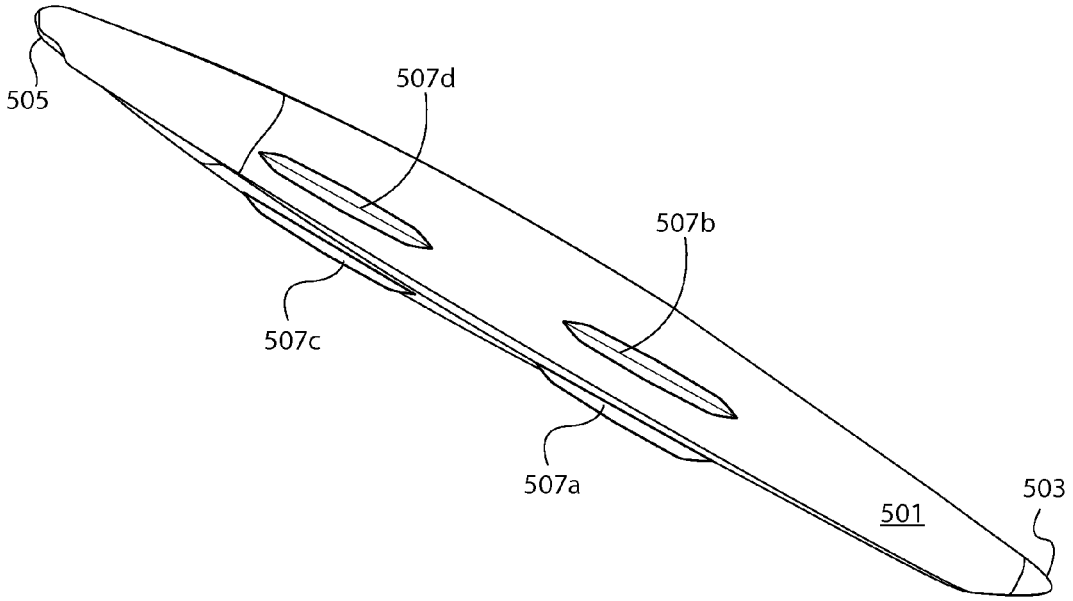
FIG. 5G is a declined perspective view of an alternate two-seat kayak in accordance with various embodiments.

As shown in FIGS. 3A-3G, in accordance with various embodiments, an open-topped kayak 300 includes a hull 301 extending between a bow 303 and a stern 305. The hull 301 includes a port portion 301*a* and a starboard portion 301*b*, divided by a longitudinal axis of the hull 301. The kayak 300 includes a first keel 307*a* protruding from the port portion 301*a* and a second keel 307*b* protruding from the starboard portion 301*b* and substantially parallel to the first keel 307*a*. The deck 313 can be configured for the paddler to sit on top, wherein the paddler sits on an open seat 311 on top of the deck 313. As best shown in FIG. 3A, the deck 313 includes first and second recesses 308*a*, 308*b*, which extend into the first and second keels 307*a*, 307*b* to receive the paddler's feet. In accordance with various embodiments, the first and second recesses 308*a*, 308*b* can each include one or more footrests 309 for receiving the paddler's feet.

As shown in FIGS. 4A-4G, in accordance with various embodiments, a two-seat kayak 400 includes a hull 401 extending between a bow 403 and a stern 405. The hull 401 includes a port portion 401*a* and a starboard portion 401*b*, divided by a longitudinal axis of the hull 401. The two-seat kayak 400 includes a first keel 407*a* protruding from the port portion 401*a* and a second keel 407*b* protruding from the starboard portion 401*b* and substantially parallel to the first keel 407*a*. The two-seat kayak 400 also includes a first seat 411 and a second seat 412 positioned aft of the first seat 411. In accordance with various embodiments, the first and second keels 407*a*, 407*b* are positioned in parallel between the bow 403 and the stern 405 of the kayak 400 and to receive the feet of a first paddler seated in the first seat 411 and to also receive the feet of a second paddler seated in the second seat 412. The two-seat kayak 400 optionally includes a deck 413 defining a first cockpit 415 vertically aligned with the first seat 411 and a second cockpit 416 positioned aft of the first cockpit 415 and vertically aligned with the second seat 412.

As shown in FIGS. 5A-5G, in accordance with various embodiments, an alternate two-seat kayak 500 includes a hull 501 extending between a bow 503 and a stern 505. The hull 501 includes a port portion 501*a* and a starboard portion 501*b*, divided by a longitudinal axis of the hull 501. The alternate two-seat kayak 500 also includes a first seat 511 and a second seat 512 positioned aft of the first seat 511. In accordance with various embodiments, the alternate two-seat kayak 500 includes a first keel 507*a* protruding from the port portion 501*a* and a second keel 507*b* protruding from the starboard portion 501*b* and substantially parallel to the first keel 507*a*. The first and second keels 507*a*, 507*b* are positioned at least partially forward of the first seat 511 to receive the feet of a first paddler seated in the first seat 511. The alternate two-seat kayak 500 also includes a third keel 507*c* protruding from the port portion 501*a* and a fourth keel 507*d* protruding from the starboard portion 501*b* and substantially parallel to the third keel 507*c*. The third and fourth keels 507*c*, 507*d* are positioned at least partially forward of the second seat 512 and aft of the first and second keels 507*a*, 507*b* to receive the feet of a second paddler seated in the second seat 512. The kayak 500 optionally includes a deck 513 defining a first cockpit 515 vertically aligned with the first seat 511 and a second cockpit 516 positioned aft of the first cockpit 515 and vertically aligned with the second seat 512.

Although described and illustrated with reference to one-seat and two-seat configurations, it will be apparent in view of this disclosure that any number of keels, seats, and/or cockpits can be used in accordance with various embodiments.

Whereas many alterations and modifications of the disclosure will no doubt become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

Additionally, although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A kayak comprising:

a single hull extending longitudinally between a bow and a stern and having a longitudinal axis extending from bow to stern, wherein the hull has a curved or rounded bottom defining a lower most hull portion along the longitudinal axis and wherein the hull includes a port portion and a starboard portion;

a first keel protruding from the port portion of the hull, the first keel positioned between the bow and the stern and sized and positioned to at least partially receive a heel and/or a foot of a paddler, the first keel having an axis which is transverse to the longitudinal axis of the hull and is essentially symmetrical on said transverse axis and the first keel being positioned at the lower most hull portion adjacent to the longitudinal axis; and a second keel protruding from the starboard portion of the hull and essentially parallel to the first keel, the second keel sized to at least partially receive a heel and/or a foot of the paddler, the second keel having an axis which is transverse to the longitudinal axis of the hull and is essentially symmetrical on said transverse axis and the second keel being positioned at the lower most hull portion at the longitudinal axis.

2. The kayak of claim 1, further comprising a deck extending from the hull, the deck and the hull together defining an interior volume of the kayak.

3. The kayak of claim 2, further comprising at least one cockpit defined in the deck.

4. The kayak of claim 1, further comprising at least one footrest positioned in each of the first keel and the second keel.

5. The kayak of claim 4, wherein the at least one footrest is repositionable within each of the first keel and the second keel.

6. The kayak of claim 1, further comprising a seat positioned aft of at least a portion of the first and second keels.

7. The kayak of claim 6, wherein the seat is repositionable relative to the first and second keels.

8. The kayak of claim 2, further comprising two or more seats, wherein each of the first and second keels is positioned to simultaneously receive a heel and/or foot of a paddler seated in each seat.

9. The kayak of claim 1, further comprising:

a first seat positioned aft of at least a portion of the first and second keels;

a third keel protruding from the port portion of the hull, the third keel positioned aft of the first keel and sized to at least partially receive a heel and/or a foot of the paddler;

a fourth keel protruding from the starboard portion of the hull and parallel to the third keel, the fourth keel sized to at least partially receive a heel and/or a foot of the paddler;

and a second seat positioned aft of at least a portion of the third and fourth keels.

10. The kayak of claim 1, wherein a length of the first keel and a length the second keel are each less than a length of the hull and a width of the first keel combined with a width of the second keel is less than a width of the hull.

11. The kayak of claim 1, wherein the hull further comprises a hull beam profile, the first keel further comprises a first keel beam profile, and the second keel further comprises a second keel beam profile.

12. The kayak of claim 11, wherein the hull beam profile is different than the first keel beam profile and the second keel beam profile.

13. The kayak of claim 12, wherein the first keel beam profile and the second keel beam profile are essentially the same.

14. The kayak of claim 1, wherein the first keel and the second keel extend away from the hull into a body of water when the kayak is deployed in the body of water.

* * * * *